US007806160B2

(12) United States Patent
Byeon

(10) Patent No.: US 7,806,160 B2
(45) Date of Patent: Oct. 5, 2010

(54) BLINDS FOR ADJUSTING ILLUMINATION MADE OF THICK MATERIAL

(76) Inventor: Tae Woong Byeon, 219-14 Deokpung-dong, Hanam-si (KR) 465-010

( * ) Notice: Subject to any disclaimer, the term of this patent is extended or adjusted under 35 U.S.C. 154(b) by 247 days.

(21) Appl. No.: 11/909,672

(22) PCT Filed: Aug. 24, 2006

(86) PCT No.: PCT/KR2006/003334

§ 371 (c)(1),
(2), (4) Date: Sep. 25, 2007

(87) PCT Pub. No.: WO2008/023857

PCT Pub. Date: Feb. 28, 2008

(65) Prior Publication Data

US 2009/0250177 A1 Oct. 8, 2009

(51) Int. Cl.
*E06B 9/40* (2006.01)

(52) U.S. Cl. ..... 160/85; 160/11; 160/120

(58) Field of Classification Search ..... 160/85, 160/86, 11, 121.1, 66, 241, 122, 120
See application file for complete search history.

(56) References Cited

U.S. PATENT DOCUMENTS

| | | | | | |
|---|---|---|---|---|---|
| 2,354,832 | A * | 8/1944 | Ristine | 160/11 |
| 3,789,904 | A * | 2/1974 | Takazawa | 160/120 |
| 3,965,960 | A * | 6/1976 | Massey | 160/295 |
| 3,980,122 | A * | 9/1976 | Takazawa | 160/85 |
| 4,418,739 | A * | 12/1983 | Woolnough et al. | 160/120 |
| 4,634,172 | A * | 1/1987 | Duda | 296/163 |
| 4,909,296 | A * | 3/1990 | Sellke et al. | 160/67 |
| 5,437,322 | A * | 8/1995 | Murray | 160/61 |
| 6,189,592 | B1 * | 2/2001 | Domel | 160/85 |
| 2005/0178509 | A1 * | 8/2005 | Byeon | 160/121.1 |
| 2006/0021713 | A1 * | 2/2006 | Hsu | 160/85 |
| 2006/0021715 | A1 * | 2/2006 | Nien | 160/121.1 |
| 2007/0084568 | A1 * | 4/2007 | Nien | 160/85 |

* cited by examiner

*Primary Examiner*—David Purol

(57) ABSTRACT

The present invention relates to a roll type blind mounted in a window for preventing light from being introduced from the outside or leaking from the inside of a room. In the blind for adjusting height and brightness made of a thick blind material according to the present invention, an inner blind material and an outer blind material of the thick blind material hang down in a tensed state by a pre-weight element and they always keep an equal width therebetween.

7 Claims, 6 Drawing Sheets

[Fig. 5]
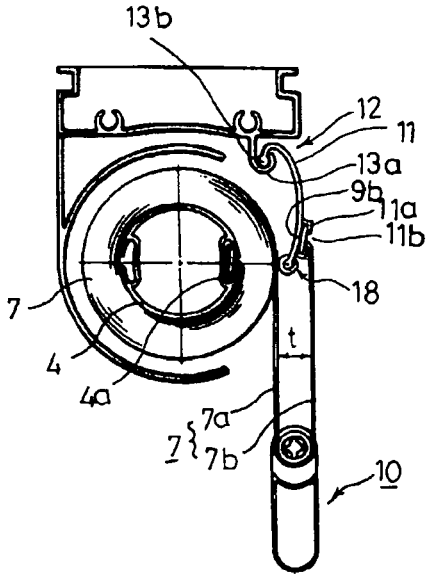
[Fig. 6]
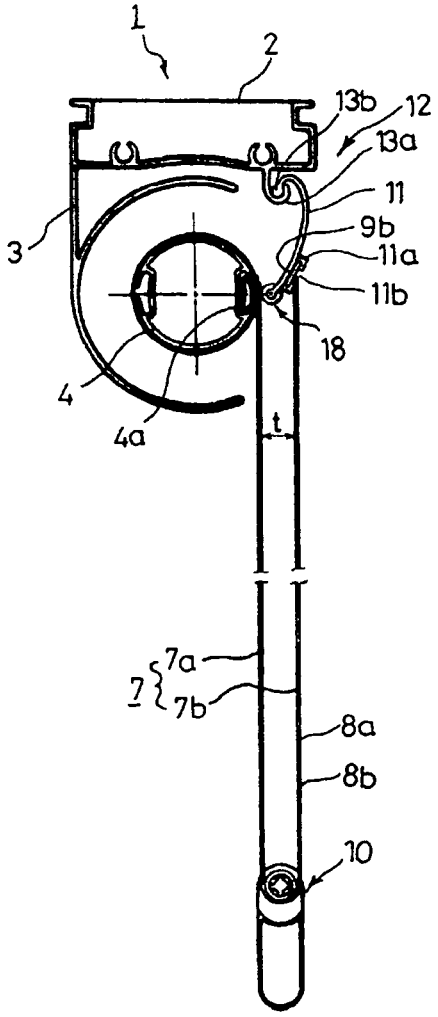

[Fig. 7]
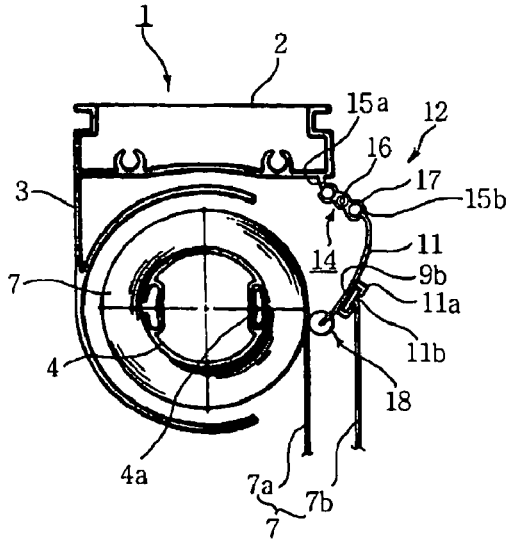
[Fig. 8]
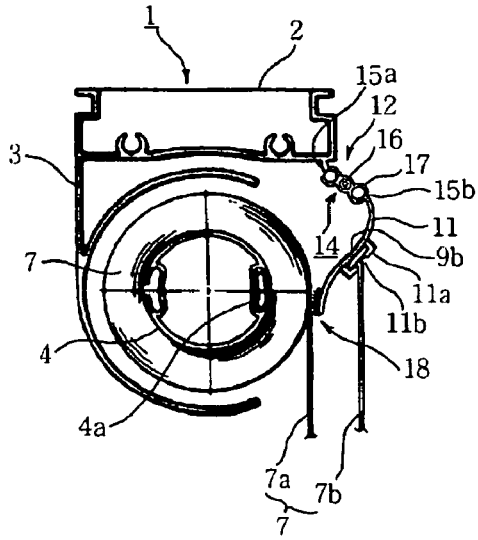
[Fig. 9]
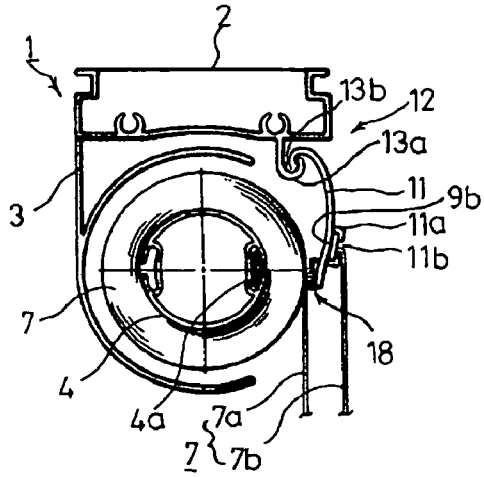

BLINDS FOR ADJUSTING ILLUMINATION MADE OF THICK MATERIAL

TECHNICAL FIELD

The present invention relates to a roll type blind mounted on a window for preventing light from being introduced from the outside or leaking from the inside of a room, and more particularly to a blind for adjusting height and brightness made of thick blind material, wherein an inner blind material and an outer blind material of the thick blind material hang down in a tensed state by a pre-weight element and they always keep an equal width therebetween.

BACKGROUND ART

In general, a shield element is mounted to an inside of a window for blocking a room from the outside, wherein the shield element may be opened or closed to control an intensity of illumination by external light, for example, sunlight.

Such a shield element is to be inevitably moved right and left, or up and down partially for the control of the illumination of a room. Therefore, the room is exposed to the outside via the window, causing invasion of privacy.

Therefore, there has been recently proposed a blind which is formed of a blind material having transparent surfaces and opaque surfaces extended repetitively to control the intensity of illumination of a room without exposing a window even partially.

FIG. 1 is a perspective view of a prior art blind for controlling height and brightness, and FIG. 2 is a longitudinal cross-sectional view of FIG. 1. Referring to FIG. 1 and FIG. 2, a prior art blind for controlling height and brightness 1 includes a winding rod 4 mounted between brackets 3, which are mounted at both ends of an upper supporting bar 2 oppositely. The winding rod 4 is mounted via a sprocket element 6 driven by a control line 5.

The upper supporting bar 2 is integrally formed with a mounting part 2*a*, to which an end, that is, a rear surface of the blind material 7 formed with transparent parts 8*a* and opaque parts 8*b* repetitively is fixed. The other end, that is, a front surface of the blind material 7 is fixed to the winding rod 4.

The winding rod 4 is formed with a mounting part 4*a* at an end and the blind material 7 is mounted with a mounting fixing bar 9*a* at the other end, so that the mounting fixing bar 9*a* is fitted into the mounting part 4*a* to fix the other end of the blind material 7 to the winding rod 4.

In the meantime, the upper supporting bar 2 has a mounting part 2*a* formed with a mounting groove 2*b* and the blind material 7 is fixed with a mounting fixing bar 9*b* at the one end, so that the mounting fixing bar 9*b* is fitted into the mounting groove 2*b*.

As above, the blind material 7 is fixed to the upper supporting bar 2 at the one end and to the winding rod 4 at the other end, so that the blind material 7 is suspended in the shape of loop, that is, in the shape of "U" with an inner blind material 7*a* and an outer blind material 7*b* from the upper supporting bar 2.

The blind material 7 hanging down in the shape of loop is provided with a pre-weight element 10 at a lower part for keeping the blind material 7 tightly in a tensed state.

Therefore, as the control line 5 of the sprocket element 6 mounted at a side of the upper supporting bar 2 is pulled in the counterclockwise direction, the winding rod 4 rotates in the counterclockwise direction, so that the inner blind material 7*a*, which is fixed to the mounting part 4*a* of the winding rod 4, is wound on the winding rod 4, and the blind material 7 covering a window is gradually lifted.

When the inner blind material 7*a* is wound on the winding rod 4 and the lower part of the blind material 7 is gradually lifted, the pre-weight element 10 mounted on the loop part keeps the blind material 7 in a tight state for helping the blind material 7 to be wound on the winding rod 4 easily.

To the contrary, as the control line 5 of the sprocket element 6 is pulled in the clockwise direction, the winding rod 4 rotates in the clockwise direction, so that the blind material 7 wound on the winding rod 4 is gradually released to hang down.

When the blind material 7 wound on the winding rod 4 is released, the pre-weight element 10 mounted on the loop part keeps the blind material 7 in the tight state.

The prior art blind for controlling the height and brightness thereof by winding or releasing the blind material 7 on or from the winding rod 4 as described above has, however, a problem that an outer diameter of the blind material 7 wound on the winding rod 4 becomes increased when a thick blind material 7 is employed for a window of a predetermined height for the purpose of insulation in winter time, even though a thin blind material has no problems for a window of the same height.

The inner blind material 7*a* and the outer blind material 7*b* are kept in parallel each other without generating any serious problems if the blind material 7 is fixed to the mounting part 4*a* of the winding rod 4 and the mounting groove 2*b* of the mounting part 2*a* of the supper supporting bar 2 and hangs down with a maximum length, completely closing a window.

If the control line 5 is pulled out and the winding rod 4 is rotated in the winding direction, that is, the clockwise direction of the blind material 7 to expose the window, the hanging blind material 7 becomes wound on the winding rod 4 gradually and the pre-weight element 10 secured on the loop part becomes lifted. By the above operation, as the blind material 7 is wound on the winding rod 4 gradually, an outer diameter of the winding rod 4 becomes increased. Then, the inner blind material 7*a* and the outer blind material 7*b* cannot keep a predetermined distance from each other and become overlapped with each other at a wound portion of the blind material 7. Therefore, the outer blind material 7*b* becomes curled together with the inner blind material 7*a* on the winding rod 4 as the winding rod 4 rotates.

On the other hand, if the inner blind material 7*a* and the outer blind material 7*b* are kept in the parallel state with each other when the outer diameter of the blind material 7 wound on the winding rod 4 becomes maximum, then the inner blind material 7*a* and the outer blind material 7*b* are kept in the parallel state with each other when the blind material 7 is wound on the winding rod 4 to the maximum and the pre-weight element 10 is positioned at an upper dead point.

However, if the control line 5 is pulled out and the winding rod 4 is rotated in the releasing direction, that is, the counterclockwise direction of the blind material 7 to cover the window completely, a distance between the inner blind material 7*a* and the outer blind material 7*b* of the blind material 7, of which the ends are fixed to the mounting part 2*a* and the winding rod 4 respectively, becomes increased. Simultaneously, the blind material 7 becomes in the shape of "V" at a side view point since the pre-weight element 10 is secured on the loop part of the blind material 7. Therefore, control of a light transmission degree or blocking of light becomes impossible when making the transparent parts 8*a* and the opaque parts 8*b* accorded with each other or controlling overlapping therebetween.

DISCLOSURE

Technical Problem

Therefore, the present invention is derived to resolve the above and any other disadvantages of the prior art.

According to the present invention, there is an object to provide a blind for adjusting height and brightness made of thick material, e.g., a thick blind material, in which an inner blind material and an outer blind material defined in the shape of loop by a pre-weight element may be kept in parallel with each other with a predetermined distance therebetween all the time even though the blind material wound on or released from a winding rod is thick.

Technical Solution

In order to achieve the above objects, according to the present invention, there is provided a blind for adjusting height and brightness, in which a blind material is formed of a thick material and fixed to a winding rod at an end and to an upper supporting bar at the other end, and a pre-weight element is secured on a loop part between an inner blind material and an outer blind material for keeping the blind material in a tensed state, characterized in that the upper supporting bar is mounted with a rotation piece at an end to rotate by a rotation element so that an end of the rotation piece is always connected to the blind material regardless of an amount of the blind material wound on the winding rod and an end of the blind material is fixed outside the rotation piece.

Advantageous Effects

According to the blind for adjusting height and brightness made of a thick blind material of the present invention as described above, an end of a rotation piece, to which the blind material is fixed, is connected to an outer peripheral surface of the blind material all the time regardless of an outer diameter, that is, a winding amount of the blind material on the winding rod, so that an interval between an inner blind material and an outer blind material is kept uniformly. Therefore, curling of the outer blind material on the winding rod may be prevented when the blind material is wound on the winding rod completely. Further, the amount of light transmission of the blind material may be properly controlled even when the blind material is completely released from the winding rod.

If a fiber protecting element is provided in a lower part of a rotation piece, the fiber protecting element may prevent generation of static electricity caused by friction between the blind material and the rotation piece, generation of contact mark caused by contact between the blind material and the rotation piece, and the generation of naps in advance, thereby expanding the lifespan of the blind material.

DESCRIPTION OF DRAWINGS

The objects, features and advantages of the present invention will be more clearly understood from the following detailed description in conjunction with the accompanying drawings, in which:

FIG. 5 and FIG. 6 are longitudinal cross-sectional views respectively showing the blind for controlling height and brightness made of a thick blind material according to a preferred embodiment of the present invention, in which FIG. 5 shows a state that the blind material is wound on a winding rod to the maximum; and FIG. 6 shows a state that the blind material is released from the winding rod;

FIG. 7 and FIG. 8 are longitudinal cross-sectional views respectively showing a rotation element employed in the blind for controlling height and brightness according to another preferred embodiment of the present invention; and FIG. 9 is a longitudinal cross-sectional view showing a fiber protecting element employed in the blind for controlling height and brightness according to a further preferred embodiment of the present invention.

MODE FOR INVENTION

Figure 1:
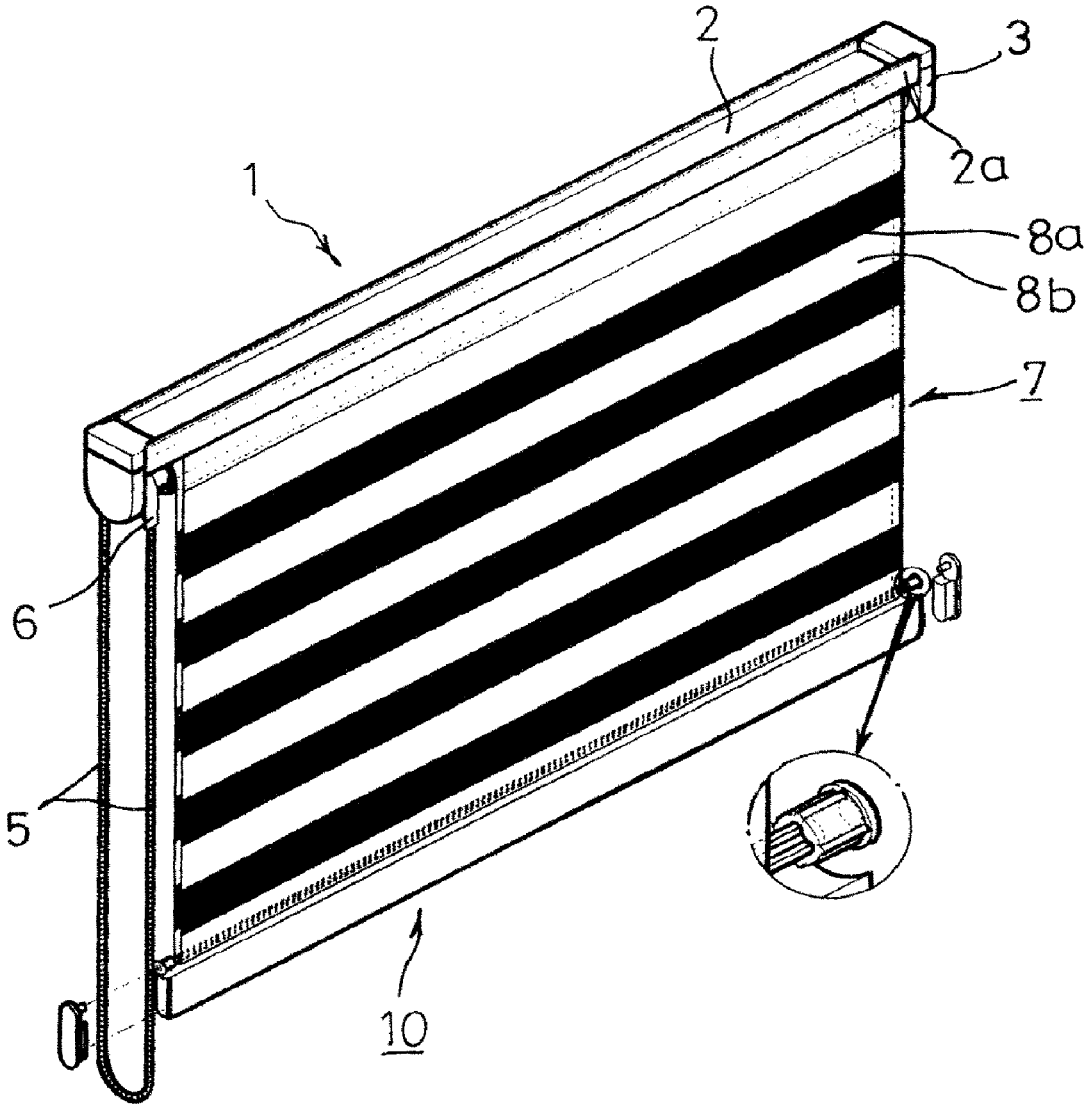
Fig. 1 PRIOR ART
FIG. 1 is a perspective view showing a prior art blind for controlling height and brightness.
Figure 2:
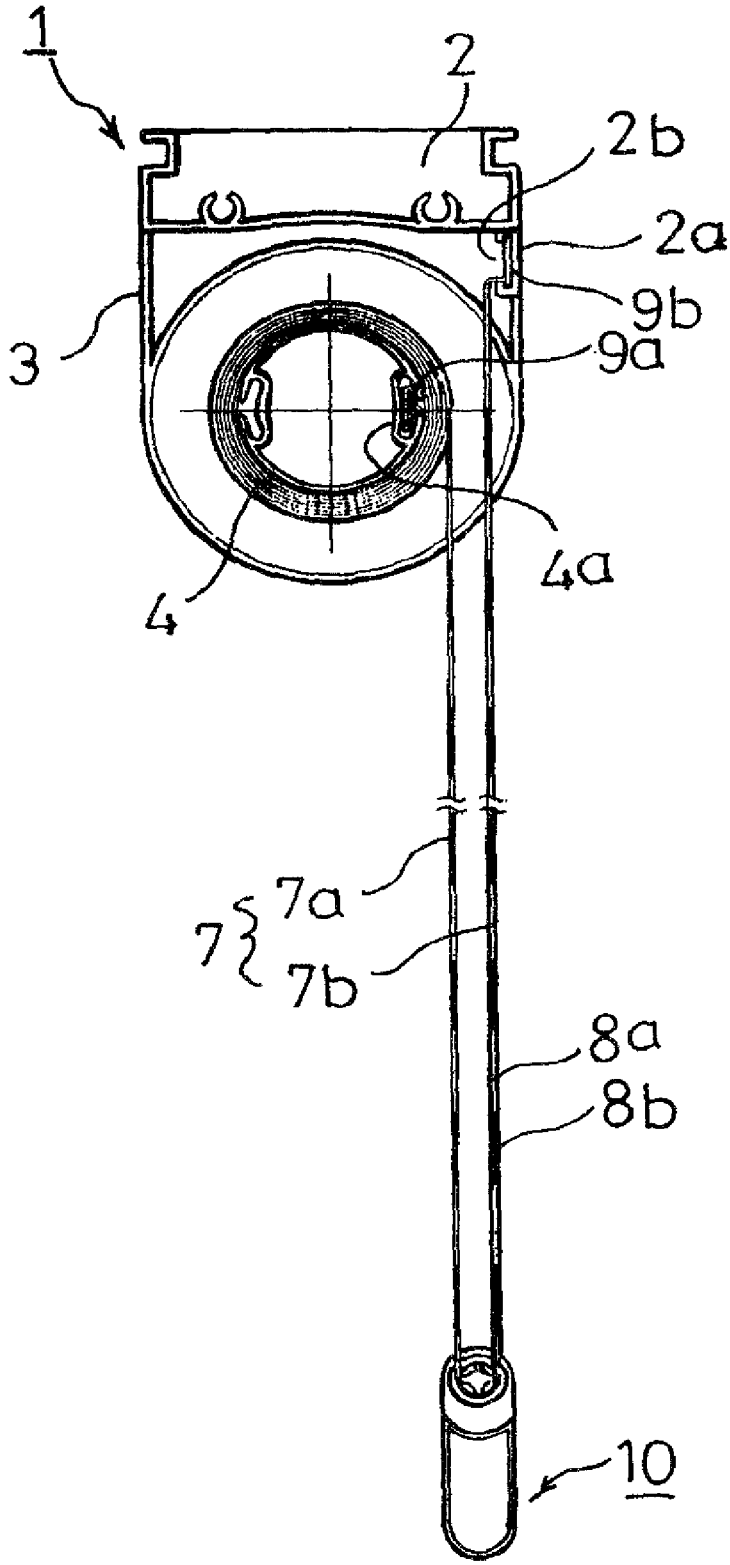
Fig. 2 PRIOR ART
FIG. 2 is a longitudinal cross-sectional view of FIG. 1.
Figure 3:
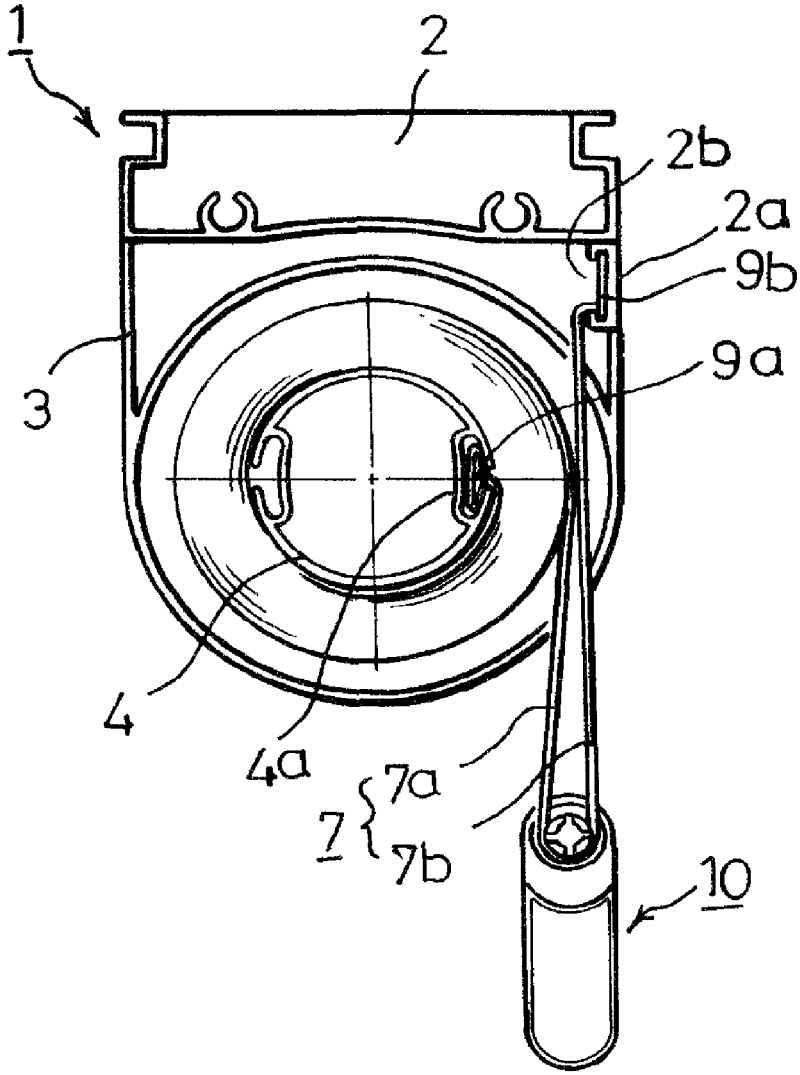
Fig. 3 PRIOR ART
FIG. 3 is a longitudinal cross-sectional view of a prior art blind, wherein a blind material hanging down vertically from a mounting part contacts a blind material wound on a winding rod and the both are curled together.
Figure 4:
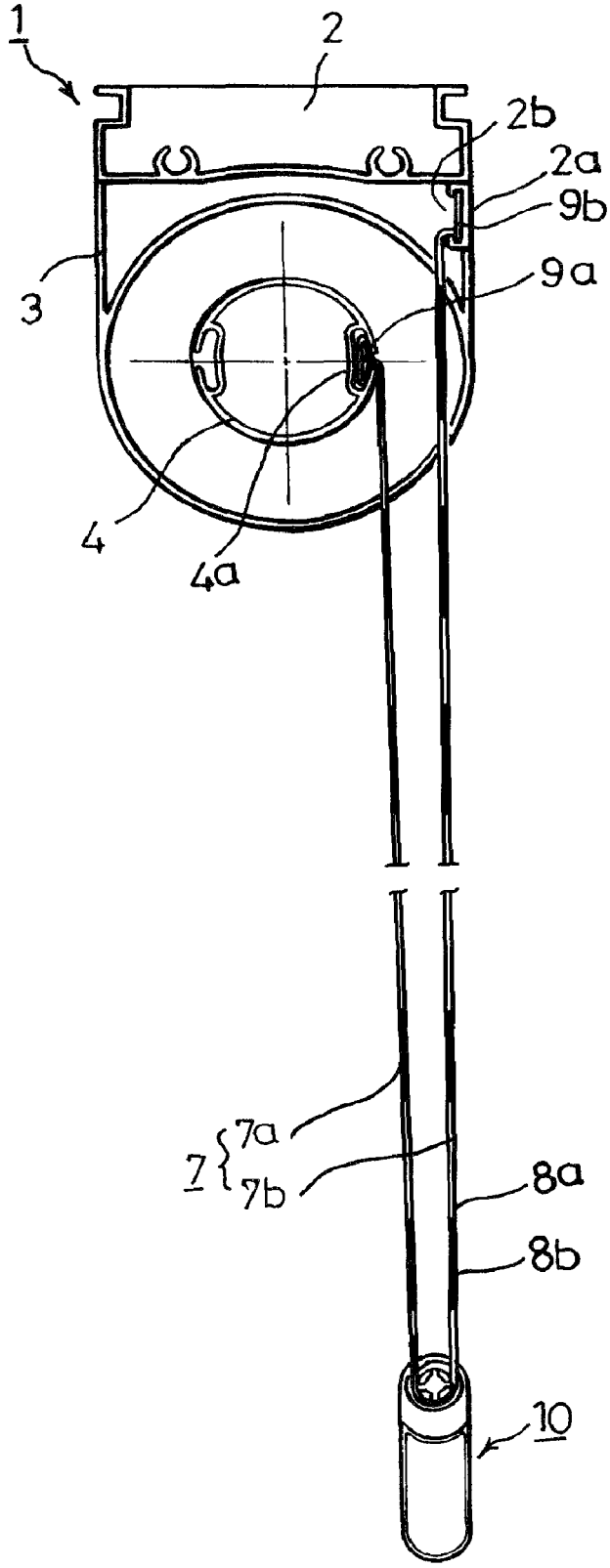
Fig. 4 PRIOR ART
FIG. 4 is a longitudinal cross-sectional view of a prior art blind, wherein a blind material wound on a winding rod hangs down with a maximum length after setting a predetermined interval between an inner blind material and an outer blind material while the blind material is wound on the winding rod to the maximum.

Now the preferred embodiments according to the present invention will be described with reference to the accompanying drawings.

FIG. 5 and FIG. 6 are longitudinal cross-sectional views respectively showing the blind for adjusting height and brightness made of a thick blind material according to a preferred embodiment of the present invention, FIG. 7 and FIG. 8 are longitudinal cross-sectional views respectively showing a rotation element employed in the blind according to another preferred embodiment of the present invention, and FIG. 9 is a longitudinal cross-sectional view showing a fiber protecting element employed in the blind according to a further preferred embodiment of the present invention.

According to the present invention, a blind material 7 has an end fitted into a mounting part 4*a* of a winding rod 4 to be fixed thereto. An upper supporting bar 2 is mounted with a rotation piece 11 at an upper end, and the rotation piece 11 rotates by a rotation element 12. The rotation piece 11 is connected to the blind material 7 at an end regardless of an amount of the blind material 7 wound on the winding rod 4. The blind material 7 is fixed outside the rotation piece 11 at the other end.

The other end of the blind material 7 may be fixed outside the rotation piece 11 by using any additional fixing element such as a band or a screw. However, in order to mount the blind material 7 to the blind of the present invention detachably as desired, the rotation piece 11 is formed with a mounting part 11*a* having a mounting groove 11*b* at an outside thereof and the blind material 7 is fixed with a mounting fixing bar 9*b*, so that the mounting fixing bar 9*b* is preferably fitted into the mounting groove 11*b*, in consideration of simple assembling work.

Referring to FIG. 5 and FIG. 6, a rotation element 12 is mounted between an end of the upper supporting bar 2 and the rotation piece 11 for rotating the rotation piece 11. In FIG. 5 and FIG. 6, the rotation element 12 includes a first holding part 13*a* formed at the end of the upper supporting bar 2 and a second holding part 13*b* formed at an end of the rotation piece 11, wherein the rotation piece 11 rotates according to an amount of the blind material 7 to be wound on the winding rod 4 so that the end of the rotation piece 11 is connected to the blind material 7 all the time.

Referring to FIG. 7 and FIG. 8, the rotation element 12 is may be formed as at least one or more hinges 14 fixed between the upper supporting bar 2 and the rotation piece 11, wherein the rotation piece 11 rotates according to the amount of the blind material 7 to be wound on the winding rod 4, so that the end of the rotation piece 11 is connected to the blind material 7 all the time.

The hinge 14 includes holding rings 15*a*, 15*b* integrally formed with the upper supporting bar 2 and the rotation piece 11, and holding elements 17 respectively fitted into the holding rings 15*a*, 15*b* and connected to each other by a shaft 16 for rotating relatively.

As described hereinabove, if the holding elements 17 are coupled via the shaft 16 with the holding rings 15*a*, 15*b*, which are respectively formed at facing surfaces of the upper supporting bar 2 and the rotation piece 11, the rotation of the rotation piece 11 is realized more smoothly in the winding or releasing operation of the blind material 7 with respect to the winding rod 4.

A fiber protecting element 18 is further provided to an inside of a lower end of the rotation piece 11, wherein the fiber protecting element 18 is connected to the blind material 7 wound on the winding rod 4.

The fiber protecting element 18 directly contacts the blind material 7, which is formed of fiber materials, so that the fiber protecting element 18 prevents generation of static electricity caused by friction simultaneously with preventing contact marks caused by the contact between the blind material 7 and the rotation piece 11, and prevents or reduces generation of naps from the blind material 7.

Even though the fiber protecting element 18 is in the shape of a roller rotative on the inner surface of the rotation piece 11 referring to FIG. 5 to FIG. 7, it is also possible to form the fiber protecting element 18 with smooth hair such as mohair fixed to the inner surface of the rotation piece 11 to contact the blind material 7 as shown in FIG. 8 and FIG. 9.

When the fiber protecting element 18 is formed in the shape of roller, the roller is preferably coated with a smooth resin material such as urethane rubber at a peripheral surface thereof for improving protecting effect thereof.

Now, the operation of the blind for adjusting height and brightness according to the present invention will be described in detail below.

FIG. 5 shows the blind material wound on the winding rod, wherein the outer diameter of the blind material 7 wound on the winding rod 4 is maximum. When the blind material 7 is wound on the winding rod 4 to the maximum as above, the fiber protecting element 18 mounted in the lower end of the rotation piece 11 and formed in the shape of roller or soft hair comes into contact with an outer peripheral surface of the blind material 7, so that the rotation piece 11 is kept as being rotated to the maximum in the counterclockwise direction with respect to the rotation element 12.

The inner blind material 7*a* of the blind material 7 hangs down from the outer peripheral surface of the winding rod 4, and the outer blind material 7*b* is fitted into the mounting part 11*a* of the rotation piece 11 to hang down, so that a uniform interval t may be kept between the inner blind material 7*a* and the outer blind material 7*b*.

When the control line 5 is pulled out to rotate the winding rod 4 in the clockwise direction in order to close an opened window (not shown) in the above situation, the blind material 7 wound on the winding rod 4 becomes released gradually so that the inner blind material 7*a* and the outer blind material 7*b* hang down by the pre-weight element 10, thereby closing the window.

Even though the outer diameter of the blind material 7 wound on the winding rod 4 becomes reduced as the blind material 7 is released from the winding rod 4 and hangs down via the above operation, the fiber protecting element 18 mounted to the rotation piece 11 is always kept in contact with the blind material 7 by the tare applied by the pre-weight element 10, so that the uniform interval is kept between the inner blind material 7*a* and the outer blind material 7*b*.

In order to control light transmission while the blind material 7 covers the window completely as above, the transparent parts 8*a* and the opaque parts 8*b* of the blind material 7 may be accorded with each other or amissed from each other by pulling out the control line 5. Then, the inner blind material 7*a* and the outer blind material 7*b* kept in a uniform interval with each other may operate in the same manner with a thin blind material, so that the light transmission control becomes convenient.

The light transmission amount control according to the fine control of the control line 5 is detailed in Korean Utility Model Registration No. 279166 of the same applicant, and the detailed description thereof will be omitted herein.

On the other hand, if the control line 5 is pulled out to rotate the winding rod 4 in the counterclockwise direction, as shown in FIG. 6, to open the window while the blind material 7 hangs down to the maximum, covering the window, the blind material 7 released from the winding rod 4 becomes wound on the winding rod 4 gradually. Therefore, the outer diameter of the blind material 7 becomes increased, wherein the outer peripheral surface of the blind material 7 wound on the winding rod 4 is in continuous contact with the fiber protecting element 18 mounted to the rotation piece 11, so that the rotation piece 11 mounted to the upper supporting bar 2 rotatively by the rotation element 12 rotates in the counterclockwise direction.

Therefore, according to the blind for controlling height and brightness of the present invention, the intensity of light in a room may be controlled as desired regardless of the amount of the blind material 7 wound on the winding rod 4 since the inner blind material 7*a* and the outer blind material 7*b* are kept in a predetermined distance from each other.

Although the foregoing description has been made with reference to the preferred embodiments, it is to be understood that changes and modifications of the present invention may be made by the ordinary skilled in the art without departing from the spirit and scope of the present invention and appended claims.

The invention claimed is:

1. A blind for adjusting height and brightness made of thick material comprising:

a blind sheet (7) including an inner blind material (7*a*) and an outer blind material (7*b*);

an upper supporting bar (2);

a winding rod (4) on which the blind sheet (7) is wound;

a pre-weight element (10) secured on a loop part formed between the inner blind material (7*a*) and the outer blind material (7*b*) to stretch the blind sheet (7) with tension; and a rotation piece (11) having a first end coupled with the upper supporting bar (2) to rotate by a rotation element (12) and a second end in contact with the inner blind material (7*a*) wound on the winding rod (4);

wherein an end of the inner blind material (7*a*) is fixed on the winding rod (4) and an end of the outer blind material (7*b*) is fixed on an external surface of the rotation piece (11).

2. The blind as claimed in claim 1, wherein the rotation element (12) includes a first holding part (13*a*) formed at an end of the upper supporting bar (2) and a second holding part (13*b*) formed at the first end of the rotation piece (11) to be fitted into the first holding part (13*a*) of the upper supporting bar (2).

3. The blind as claimed in claim 1, wherein the rotation element (12) is one or more hinges (14) provided between the upper supporting bar (2) and the rotation piece (11).

4. The blind as claimed in claim 3, wherein the hinges (14) include insertion balls (15*a*, 15*b*), which are respectively formed at the end of the upper supporting bar (2) and at the first end of the rotation piece (11), and holding elements (17) axially coupled with each other to rotate relatively and to receive the insertion balls (15*a*, 15*b*) therein.

5. The blind as claimed in claim 1, wherein a fiber protecting element (18) is further provided at the second end of the rotation piece (11) to be in contact with the inner blind material (7*a*) wound on the winding rod (4).

6. The blind as claimed in claim 5, wherein the fiber protecting element (18) is a roller rotatively mounted on the second end of the rotation piece (11).

7. The blind as claimed in claim 5, wherein the fiber protecting element (18) is made of soft hair and fixed on an inner surface of the rotation piece (11) to be in contact with the inner blind material (7*a*).

* * * * *